United States Patent [19]

Milliken et al.

[11] Patent Number: 4,926,605

[45] Date of Patent: May 22, 1990

[54] CONSTRUCTION ASSEMBLY FOR CLOSURE STRUCTURE

[76] Inventors: Les Milliken, 101 S. McCall Rd.; K. Blair Milliken, 305 Gladstone Blvd., both of, Englewood, Fla. 34223

[21] Appl. No.: 191,419

[22] Filed: May 9, 1988

[51] Int. Cl.[5] ..... E04H 15/18

[52] U.S. Cl. ..... 52/63; 52/222; 160/392; 160/395; 160/398

[58] Field of Search ..... 52/63, 222, 202, 203; 160/391, 392, 395, 398, 404, 399

[56] References Cited

U.S. PATENT DOCUMENTS

| | | | |
|---|---|---|---|
| 735,540 | 8/1903 | Lyon | 160/398 |
| 766,257 | 8/1904 | Janes | 160/398 |
| 3,874,731 | 4/1975 | Jordan | 297/458 |
| 4,025,114 | 5/1977 | Cave | 297/458 |
| 4,092,992 | 6/1978 | Huddle | 52/63 |
| 4,189,880 | 2/1980 | Ballin | 52/202 |
| 4,274,234 | 6/1981 | Abell | 52/63 |
| 4,341,255 | 7/1982 | Mock | 160/395 |
| 4,355,478 | 10/1982 | Armstrong | 160/395 |
| 4,690,192 | 9/1987 | Stilling | 160/395 |

FOREIGN PATENT DOCUMENTS

| | | | |
|---|---|---|---|
| 1145921 | 5/1983 | Canada | 52/222 |
| 626844 | 3/1936 | Fed. Rep. of Germany | 160/395 |
| 2158502 | 5/1973 | Fed. Rep. of Germany | 52/63 |
| 2254345 | 5/1974 | Fed. Rep. of Germany | 52/63 |
| 7507473 | 12/1976 | Netherlands | 160/395 |
| 365055 | 1/1932 | United Kingdom | 52/63 |

*Primary Examiner*—Michael Safavi

*Attorney, Agent, or Firm*—Gifford, Groh, Sprinkle, Patmore and Anderson

[57] ABSTRACT

A construction assembly for closures, including awnings, canopies, boat coverings, signs and displays having a frame composed of aluminum and the like including channelled, joinable members preferably for assembly by welding into a frame, a covering material formed from a textile, and flexible trim pads for interlocking the covering material into the channels of the joinable members. The assembly includes staples to act as anchors to hold the material into place before forced insertion of the flexible fasteners. In cross section, the joinable members have a round or a multi-sided configuration.

5 Claims, 2 Drawing Sheets

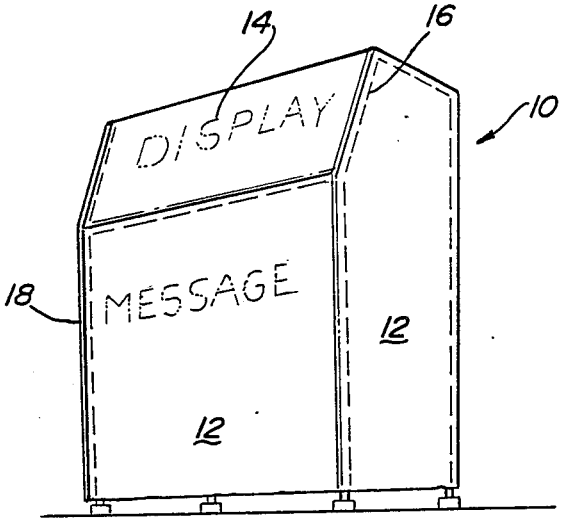
Fig-4
Fig-1
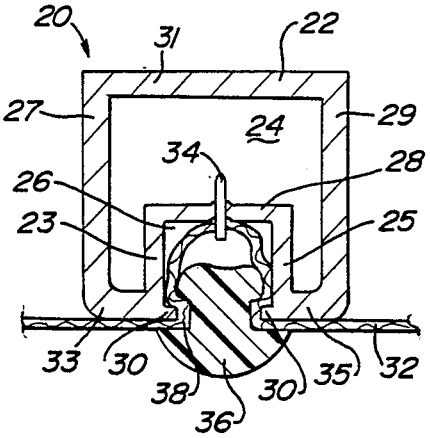
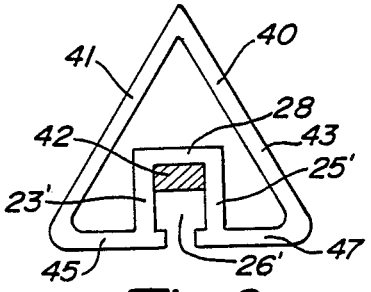
Fig-2
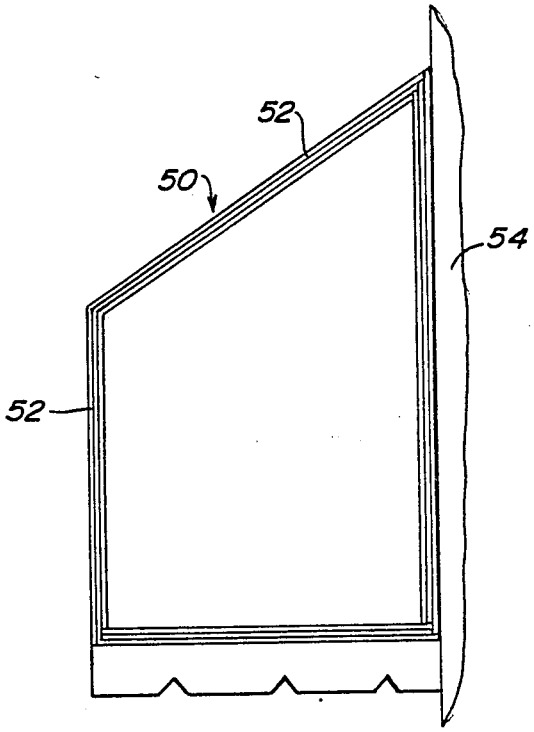
Fig-5
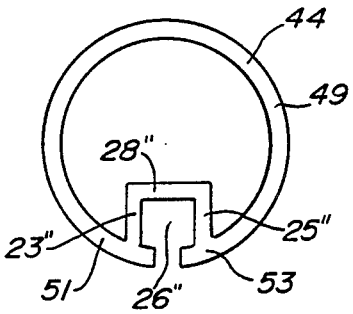
Fig-3

CONSTRUCTION ASSEMBLY FOR CLOSURE STRUCTURE

BACKGROUND OF THE INVENTION

I. Field of the Invention

The present invention relates generally to construction assemblies for closure structures. More particularly, the present invention relates to a construction assembly for awnings, canopies, boat coverings, displays, signs and the like including a frame, a covering, and removable flexible string for interlocking the covering into the frame.

II. Description of the Relevant Art

Shading and closure structures, more particularly, awnings, canopies, boat coverings, displays, signs or the like, are typically provided with a frame fixed to a base or support structure and a covering material placed over the frame.

Conventionally, closures, particularly awnings and canopies, have one of two distinct constructions. The first construction, that typical in the United States, includes a frame composed of tubular aluminum members shaped and welded together. Once the frame is established, material is stretched thereover and tied to the frame. This construction offers flexibility of form in that the tubular members can be bent to form closures having arcuate shapes. However, this construction suffers from an inefficient method for attaching the covering material to the frame.

The second construction, that typical in many European countries, includes a frame composed of substantially flat elongated members having slots which are attached to one another by mechanical fasteners. This structure is assembled at the factory largely because of the complexity of the fastening system and is shipped to the building site. Thereafter the covering is placed over the frame and is connected to the frame by connecting strips which snap into the slots of the elongated members. While this system offers the advantage of securely fitting the covering material to the frame, the elongated members themselves cannot be sent to form frames having arcuate shapes. In addition, the method of first assembling the frames prior to shipment is inconvenient.

Accordingly, prior inventions have failed to eliminate the problems of inconvenience and inefficiency commonly associated with construction assemblies for closures.

SUMMARY OF THE PRESENT INVENTION

The present invention is a construction assembly for closures including awnings, canopies, boat coverings, displays, signs and the like which includes a frame comprised of a number of elongated, joinable members, each member having a longitudinal channel provided therein, a flexible covering material formed from a textile or vinyl or a similar plastic, and a system for interlocking the covering material with the channels defined in the frames.

The system includes anchors for holding the material into the channels, such anchors being staples, for example, and flexible, elongated trim pads which are force-fittable into the channels. The flexible, elongated trim pads further seal the covering material to the frame in such a way that no wear occurs at the anchors and water and dirt is kept out of the interior of the canopy or awning.

The frame may be composed of a metal, preferably aluminum or steel, whereas the flexible trim is preferably composed of a polymerizable material such as a soft plastic or rubber. The frame is preferably welded together, although hinged fasteners may be used.

In cross section, the joinable members may be one of two preferred configurations. In the first configuration, the cross section of the member is multi-sided and has a hollow core. In the second configuration, the cross section of the member is substantially round and also has a hollow core.

Other advantages and features of the present invention will become more apparent from the following detailed description when read in conjunction with the accompanying drawings.

BRIEF DESCRIPTION OF THE DRAWINGS

The present invention will be more fully understood by reference to the following detailed description of the preferred embodiments of the present invention when read in conjunction with the accompanying drawings, in which like reference characters refer to like parts throughout the views, and in which:

FIG. 1 is an assembled view showing the elements of a preferred embodiment of the present invention shown in cross section;

FIG. 2 is an alternate embodiment of the frame member of the present invention shown in cross section;

FIG. 3 is an other alternate embodiment of the frame member of the present invention shown in cross section;

FIG. 4 is a perspective view of a construction assembly according to the present invention employing the frame structure embodied in FIG. 1;

FIG. 5 is a side view of another construction assembly employing the frame structure embodied in FIG. 1;

DETAILED DESCRIPTION OF THE PREFERRED EMBODIMENT OF THE INVENTION

Figure 6:
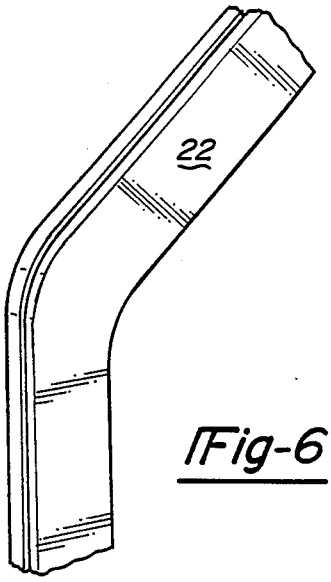
FIG. 6 is a partial perspective view of the member shown in FIG. 1 having an arcuate shape.

FIGS. 1-8 show preferred embodiments of the present invention. While the configurations according to the illustrated embodiments are preferred, it is envisioned that alternate configurations of the present invention may be adopted without departing from the invention as portrayed. The preferred embodiments are discussed hereafter.

With reference to FIG. 1, there is shown in cross section an assembled view of a preferred construction of the present invention.

The assembly, generally indicated by 20, comprises a substantially hollow, square-shaped channelled member 22. On one side of the channelled member 22 is defined a channel 26 having therein a channel base 28 and a pair of opposing flanges 30 provided at the mouth of the channel 26. The channel 26 is defined by a first channel wall 23 and a second channel wall 25 whereby the channel base 28 is disposed therebetween. The outer structure of the channeled member 22 includes a first side member 27, a second side member 29 and a base member 31 disposed therebetween. Interconnecting the first channel wall 23 and the first side member 27 is a first adjacent wall 33. Interconnecting the second channel wall 25 and the second side member 29 is a second adjacent wall 35. The channelled member 22 may be composed of aluminum or steel, although conceivably its composition may be of a plastic.

A portion of a covering material 32 is shown fitted in place on the channelled member 22. Some of the material 32 is gathered into the channel 26. The material 32 is primarily anchored into place by a staple 34 which anchors the material 32 to the base 28 of the channel 26. Conceivably, the staple 34 may be substituted by a conventional fastener such as a rivet or a screw (not shown).

A flexible trim pad 36 is provided having a pair of longitudinal slots 38 defined on a plane therein and provided on opposite sides of the pad 36. The pad 36 is preferably composed of a polymerizable material such as a soft plastic or rubber. The pliable nature of the pad 36 allows for slots 38 to interlock with the flanges 30 of the channelled member 22, thereby interlocking the material 32 therein. This construction provides for a tight seal, thereby reducing the possibility of the material 32 shifting relative to the channelled member 22. This close tolerance also prevents water or dirt from entering the channel 26.

In addition, and again because of its pliable nature, the pad 36 may also be readily removed from replacement of the material 32.

To provide greater structural integrity, the channelled member 22 has an inner chamber 24 defined therein. Two or more chambers may alternatively be used as desired to provide greater structural integrity.

With reference to FIG. 2, an alternate embodiment of the frame member according to the present invention is shown. A channelled frame member 40 is shown in cross section, thus revealing its rectangular shape. A channel 26′ is defined therein having a channel base 28′. The channel 26′ is defined by a first channel wall 23′ and a second channel 25′ whereby the channel base 28′ is disposed therebetween. The outer structure of the channeled frame member 40 includes a first side member 41 interconnecting at one edge a second side member 43. Interconnecting the first channel wall 23′ and the first side member 41 is a first adjacent wall 45. Interconnecting the second channel wall 25′ and the second side member 43 is a second adjacent wall 47.

Like the channelled member 22 discussed above relative to FIG. 1, the channelled member 40 may be composed of aluminium or steel. If the preferred material is steel, staples will not be conventionally drivable through the base 28′ of the channelled member 40. Accordingly, a strip 42 of nylon or a similar material is provided in the channel 26′ for receiving staples or the like.

Referring to FIG. 3, another embodiment of the frame member according to the present invention is shown indicated by 44. The channelled frame member 44 is shown in cross section, thereby disclosing its substantially round shape. A channel 26″ is defined therein by a first channel wall 23″ and a second channel wall 25″ whereby a channel base 28″ is disposed therebetween. The outer structure of the channeled member 44 includes a round body wall 49 having a first adjacent wall portion 51 which interconnects the first channel wall 23″ and a second adjacent wall portion 53 which interconnects the second channel wall 25″.

Referring to FIG. 4, there is shown a preferred embodiment of a construction assembly for a closure used as a display according to the present invention, generally indicated by 10. The display 10 is here used as a medium for display which is lightweight and easily constructed. The display includes a covering portion 12 which may include a picture or words 14. An internal frame 16 is indicated by broken lines having a number of trim pads 18 attached thereto.

With reference to FIG. 5, a side view of a suggested closure according to the present invention is shown. The closure illustrated is generally fashioned to function as an awning assembly generally indicated by 50, although it may be formed as a canopy, a boat cover, a roof, or the like.

The closure 50 comprises channelled members 22 (of FIG. 1), 40 (of FIG. 3), or 44 (of FIG. 3) which are welded together to form a frame. The closure 50, as illustrated, attaches to a wall structure 54.

With reference to FIG. 6, a portion of the channelled member 22 of FIG. 1 is shown in detail. As shown, the channelled member 22 is bent to illustrate its versatility of application. While the channelled member 22 is bent at an angle greater than 90°, the degree of angle may be altered to equate a 90° angle.

Figure 7:
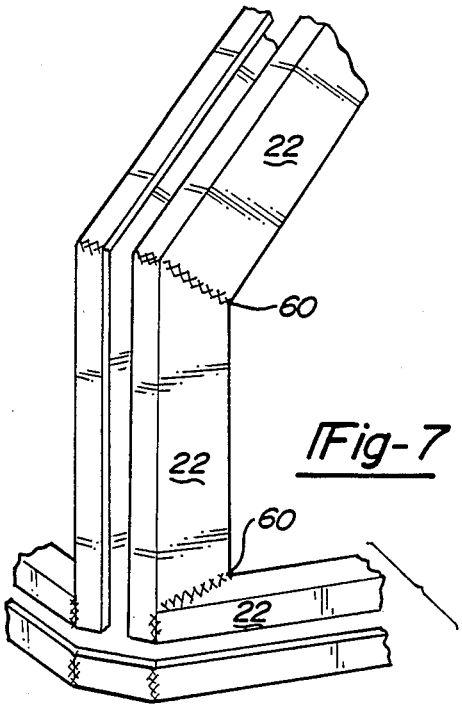
FIG. 7 is a partial perspective view of joined members of the embodiment of the present invention shown in FIG. 1.

Referring to FIG. 7, a number of channelled members 22 of FIG. 1 are shown welded together to further illustrate the versatility of the present invention. The channelled members 22 are abutted against one another at joints 60. The channelled members 22 may be joined by welding (as illustrated) or by interlocking with hinged fasteners (not shown). The degree of angle may be varied, virtually without limitation, from the degrees shown.

Figure 8:
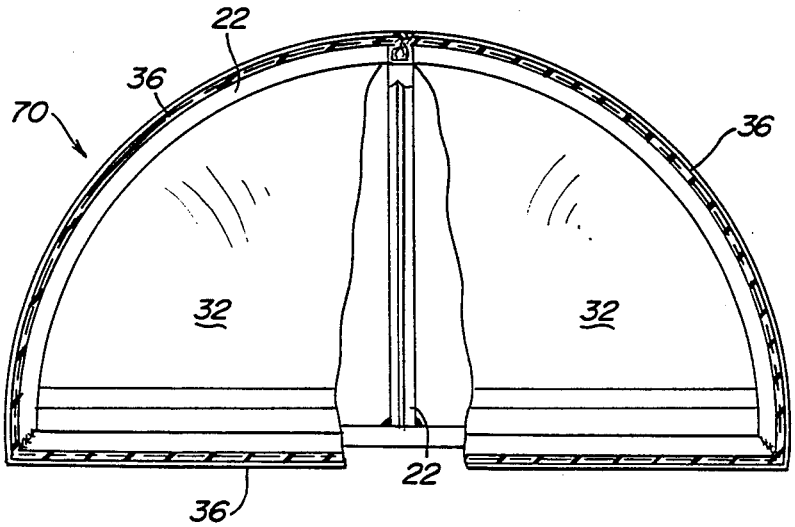
FIG. 8 is a sectional view of a construction assembly according to the present invention employing the frame structure embodied in FIG. 3.

Referring to FIG. 8, a sectional view of an awning assembly generally indicated by 70 is shown. The awning 70 is covered by a material 32. The awning 70, which may also be structured as a canopy or a roof structure, comprises a number of arcuately formed channelled members 22 as illustrated above in FIG. 1. Of course, the channelled members 40 (of FIG. 2) or 44 (of FIG. 3) may be used in the alternative or in combination. Due to the flexibility of the channelled members 22 accorded because of their square-shaped, single-chambered design as discussed above with respect to FIG. 1, the arcuate form illustrated can be achieved. The material 32 is fastened to the channelled members 22 by means of the flexible trim pads 36.

In summary, a construction assembly for closures such as awnings, canopies, roofs, displays, or boat coverings and the like is assembled by first establishing a frame structure using one (or more) of channelled members 22, 40 or 44 depending on preference. Thereafter, a selected portion of the covering material 32 is laid over the established frame. A small excess of material 32 is forced into the channel of the selected member and is loosely fitted therein. The material is thereafter anchored into the channels by driving anchoring staples 34 through the material 32. Thereafter, the trim pads 36 are forced fitted into the channels.

Having set forth the present invention and what is considered to be the best embodiments thereof, it will be understood that changes may be made from the specific embodiments set forth without departing from the spirit of the invention or exceeding the scope thereof as defined in the following claims.

I claim:

1. A construction assembly for closures and the like comprising:

a plurality of substantially elongated joinable members;

said elongated members each having defined therein at least one longitudinal channel, said channel being defined by a first channel wall, a second channel wall, and a channel base disposed therebetween;

a covering material;

means for anchoring said covering material into said channel of selected ones of said elongated members, said means for anchoring comprises a plurality of staples;

a plurality of flexible elongated trim pads having at least two coplanar longitudinal slots defined therein; and said elongated trim pads adapted to be fixed into said channels thereby substantially locking said covering material therein and forming a tight seal thereby;

each of said joinable members being hollow and having an outer periphery which is substantially squareshaped in cross section;

said square shape being defined by a first side member having a base member edge and a first adjacent wall edge, a second side member having a base member edge and a second adjacent wall edge, a base member interconnecting said base member edges of said first side member and said second side member, a first adjacent wall interconnecting said first adjacent wall edge of said first side member and said first channel wall, and a second adjacent wall interconnecting said second adjacent wall edge of said second side member and said second channel wall.

2. A construction assembly for closures and the like comprising:

a plurality of substantially elongated joinable members;

said elongated members each having defined therein at least one longitudinal channel, said channel being defined by a first channel wall, a second channel wall, and a channel base disposed therebetween;

a covering material;

means for anchoring said covering material into said channel of selected ones of said elongated members, said means for anchoring comprises a plurality of staples;

a plurality of flexible elongated trim pads having at least two coplanar longitudinal slots defined therein; and said elongated trim pad adapted to be fixed into said channels thereby substantially locking said covering material therein and forming a tight seal thereby;

each of said joinable members being hollow and having an outer periphery which is substantially triangular-shaped in cross section;

said triangular shape being defined by a first side member having a member edge and a first adjacent wall edge, a second member having a second adjacent wall edge and a member edge interconnected with said member edge of said first side member, a first adjacent wall interconnecting said first adjacent wall edge of said first side member and said first channel wall, and a second adjacent wall interconnecting said second adjacent wall edge of said second side member and said second channel wall.

3. A construction assembly for closures and the like comprising:

a plurality of substantially elongated joinable members;

said elongated members each having defined therein at least one longitudinal channel, said channel being defined by a first channel wall, a second channel wall, and a channel base disposed therebetween;

a covering material;

means for anchoring said covering material into said channel of selected ones of said elongated members, said means for anchoring comprises a plurality of staples;

a plurality of flexible elongated trim pads having at least two coplanar longitudinal slots defined therein;

said elongated trim pads adapted to be fixed into said channels thereby substantially locking said covering material therein and forming a tight seal thereby;

each of said joinable members being hollow and having an outer periphery which is substantially round-shaped in cross section;

said round shape being defined by a substantially round body member having a first adjacent end portion interconnecting said first channel wall and a second adjacent end portion interconnecting said second channel wall.

4. A construction assembly for closures and the like comprising:

a plurality of substantially elongated joinable members;

said elongated members each having defined therein at least one longitudinal channel;

said channel including a first channel wall, said first wall having a base edge and a first adjacent wall edge, a second channel wall, said second wall having a base edge and a second adjacent wall edge, and a base interconnecting said base edges of said first and second channel walls;

a first adjacent wall interconnected with said first adjacent wall edge of said first channel wall;

a second adjacent wall interconnected with said second adjacent wall edge of said second channel wall;

a covering material;

means for anchoring said covering material into said channel of selected ones of said elongated members, said means for anchoring comprises a plurality of staples;

a plurality of flexible elongated trim pads having at least two coplanar longitudinal slots defined therein;

said elongated trim pads adapted to be fixed into said channels thereby substantially locking said covering material therein and forming a tight seal thereby;

said elongated member being composed of aluminum.

5. A construction assembly for closures and the like comprising:

a plurality of substantially elongated joinable members;

said elongated members each having defined therein at least one longitudinal channel;

said channel including a first channel wall, said first wall having a base edge and a first adjacent wall edge, a second channel wall, said second wall having a base edge and a second adjacent wall edge, and a base interconnecting said base edges of said first and second channel walls;

a first adjacent wall interconnected with said first adjacent wall edge of said first channel wall;

a second adjacent wall interconnected with said second adjacent wall edge of said second channel wall;

a covering material;

means for anchoring said covering material into said channel of selected ones of said elongated members, said means for anchoring comprises a plurality of staples;

a plurality of flexible elongated trim pads having at least two coplanar longitudinal slots defined therein;

said elongated trim pads adapted to be fixed into said channels thereby substantially locking said covering material therein and forming a tight seal thereby;

said elongated member being composed of steel.

* * * * *

US004926605B1

REEXAMINATION CERTIFICATE (2049th)

United States Patent [19]

[11] B1 4,926,605

Milliken et al.

[45] Certificate Issued Jun. 29, 1993

[54] CONSTRUCTION ASSEMBLY FOR CLOSURE STRUCTURE

[76] Inventors: Les Milliken, 101 S. McCall Rd.; K. Blair Milliken, 305 Gladstone Blvd., both of Englewood, Fla. 34223

Reexamination Request:
No. 90/002,129, Sep. 10, 1990

Reexamination Certificate for:

| | |
|---|---|
| Patent No.: | **4,926,605** |
| Issued: | **May 22, 1990** |
| Appl. No.: | **191,419** |
| Filed: | **May 9, 1988** |

[51] Int. Cl.[5] ..... E04H 15/18
[52] U.S. Cl. ..... 52/63; 52/222; 160/392; 160/395; 160/398
[58] Field of Search ..... 52/63, 73, 74, 222, 52/202, 203; 160/391-399, 404

[56] References Cited

U.S. PATENT DOCUMENTS 4,074,811 2/1978 Filak .
4,092,992 6/1978 Huddle .

FOREIGN PATENT DOCUMENTS 2158502 5/1973 Fed. Rep. of Germany .
522798 6/1972 Switzerland .

OTHER PUBLICATIONS

Various BAT-Italia and other technical and promotional literature (See Exhibits A through H of Larry M. Fisher Declaration).

*Primary Examiner*—Carl Friedman

[57] ABSTRACT

A construction assembly for closures, including awnings, canopies, boat coverings, signs and displays having a frame composed of aluminum and the like including channelled, joinable members preferably for assembly by welding into a frame, a coveing material formed from a textile, and flexible trim pads for interlocking the covering material into the channels of the joinable members. The assembly includes staples to act as anchors to hold the material into place before forced insertion of the flexible fasteners. In cross section, the joinable members have a round or a multi-sided configuration.

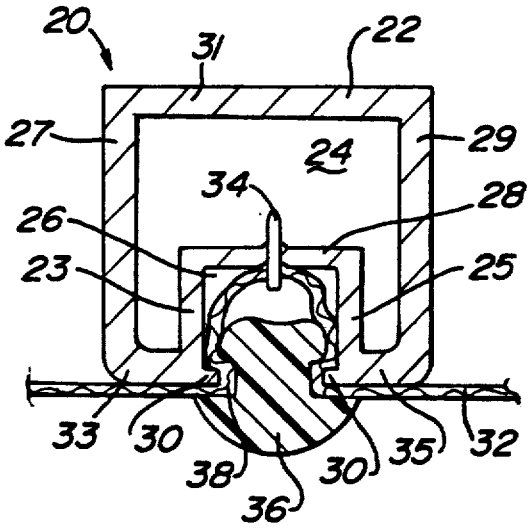

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1 and 2 is confirmed.

Claims 3-5 are cancelled.

New claims 6 and 7 are added and determined to be patentable.

*6. An awning structure comprising:*

*a plurality of substantially elongated framing members;*

*said framing members each having defined therein at least one longitudinal channel, said channel being defined by a first channel wall, a second channel wall, and a channel base disposed therebetween and connected with said channel walls;*

*a covering material;*

*means for anchoring said covering material into said channels of said framing members, said means comprising a plurality of staples;*

*a plurality of flexible elongated trim pads having at least two coplanar slots defined therein; and*

*said elongated trim pads adapted to be fixed into said channels thereby substantially locking said covering material therein and forming a tight seal thereby;*

*each of said framing members being hollow and having an outer periphery which is substantially square shaped in cross-section;*

*said substantial square shape being defined by a first side member, a second side member and a base member joining the side members together in parallel relationship along an edge of each of said side members to define a framing member having a pair of spaced elongated parallel extending side members joined together by a substantially perpendicularly extending elongated base member to thereby form an elongated slot;*

*said first channel wall, said second channel wall and said channel base being formed within said framing member slot with said channel base spaced inwardly from and extending substantially parallel to said base member.*

*7. An awning structure comprising;*

*a plurality of substantially elongated formable framing members;*

*said framing members being hollow and substantially square in cross section and comprising a first side member and a second side member spaced by and integrally joined to a base member and a wall spaced from and parallel to said base member joining said side members in substantially parallel relationship;*

*said framing members each having defined therein at least one longitudinal channel;*

*said channel being formed by a slot in said wall, a first channel member and second channel member extending inwardly into said framing member from said wall in substantially parallel relationship with each other and with said side members and a channel base integrally joined to and extending between said channel walls, said channel base spaced inwardly from and extending substantially parallel to said wall and said base member;*

*a covering material;*

*means for anchoring said covering material into said channel of selected ones of said framing members, said means for anchoring comprising a plurality of staples;*

*a plurality of flexible elongated trim pads having at least two coplanar slots defined therein; and*

*said elongated trim pads adapted to be fixed into said channels thereby substantially locking said covering material therein and forming a tight side seal thereby.*

* * * * *